US006712047B2

(12) United States Patent
Rueger

(10) Patent No.: US 6,712,047 B2
(45) Date of Patent: Mar. 30, 2004

(54) METHOD FOR DETERMINING THE RAIL PRESSURE OF AN INJECTOR HAVING A PIEZOELECTRICAL ACTUATOR

(75) Inventor: Johannes-Joerg Rueger, Vienna (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/239,585

(22) PCT Filed: Jan. 17, 2001

(86) PCT No.: PCT/DE01/00175

§ 371 (c)(1),
(2), (4) Date: Feb. 27, 2003

(87) PCT Pub. No.: WO01/73282

PCT Pub. Date: Oct. 4, 2001

(65) Prior Publication Data

US 2003/0154806 A1 Aug. 21, 2003

(30) Foreign Application Priority Data

Mar. 24, 2000 (DE) ..... 100 14 737

(51) Int. Cl.[7] ..... F02M 51/00
(52) U.S. Cl. ..... 123/479; 123/456; 73/119 A
(58) Field of Search ..... 123/198 D, 479, 123/467, 447, 446, 456, 494; 73/117.2, 117.3, 119 A

(56) References Cited

U.S. PATENT DOCUMENTS 4,045,687 A 8/1977 Maringer
4,491,112 A * 1/1985 Kanegae et al. ..... 123/479
5,168,192 A 12/1992 Kosugi et al.
5,526,788 A * 6/1996 Noble et al. ..... 123/406.37
5,893,352 A * 4/1999 Fujiwara ..... 123/479
5,934,256 A * 8/1999 Wenzlawski et al. ..... 123/479
6,021,760 A * 2/2000 Boecking ..... 123/467
6,147,433 A * 11/2000 Reineke et al. ..... 310/316.03
6,234,404 B1 * 5/2001 Cooke ..... 239/88
6,478,013 B1 * 11/2002 Boecking ..... 123/467

FOREIGN PATENT DOCUMENTS

EP 0 971 119 1/2000
JP 01 147142 6/1989

OTHER PUBLICATIONS

Patent Abstracts of Japan, vol. 013, No. 405 (M–868), Sep. 7, 1989*.

* cited by examiner

*Primary Examiner*—Carl S. Miller
(74) *Attorney, Agent, or Firm*—Kenyon & Kenyon

(57) ABSTRACT

A method for determining the rail pressure of an injector including a voltage-controlled piezoelectrical actuator, the piezoelectrical actuator actuating a nozzle needle using hydraulic coupler. As a result of the pressure in the high-pressure channel, a coupler pressure is built up via the hydraulic coupler, the coupler pressure inducing a piezo-voltage in the actuator. Because this voltage value is redundant with regard to the pressure value in the high-pressure channel, which is measured by a pressure sensor, the voltage value is used for monitoring the functioning of the pressure sensor. In the event of the failure of the pressure sensor, emergency operation is built up for the injector with the assistance of the induced voltage. The injector advantageously functions for injecting fuel in an internal combustion engine.

9 Claims, 2 Drawing Sheets

METHOD FOR DETERMINING THE RAIL PRESSURE OF AN INJECTOR HAVING A PIEZOELECTRICAL ACTUATOR

FIELD OF THE INVENTION

The present invention relates to a method for determining the rail pressure of an injector including a voltage-controlled piezoelectrical actuator.

BACKGROUND INFORMATION

Conventionally, in an injector including a piezoelectrical actuator, the motion of the nozzle needle is not driven directly but via a hydraulic coupler. One task of the coupler is to reinforce the stroke of a control valve. For correct functioning, however, the hydraulic coupler must be completely charged, especially since in every driving of the piezoelectrical actuator a portion of the fluid is squeezed out of the hydraulic coupler through leakage gaps. In this context, the recharging occurs in the pause between two injections. In order to release a predetermined quantity of fluid in the high-pressure channel, it is necessary to know the pressure in the high-pressure channel. This pressure may be measured by an appropriate sensor, which is arranged in the high-pressure line system (common rail system) at an appropriate location. In this context, the problem may arise that an erroneous rail pressure measurement may result from the failure of the pressure sensor. Due to the incorrect rail pressure measurement, it is then no longer assured that the predetermined injection quantity will actually be released. This may be critical especially in a motor-vehicle including an internal combustion engine, if the predetermined quantity of fuel is not injected. The result may be abrupt disruptions in functioning and potentially the shutdown of the internal combustion engine. Furthermore, undesirable, large injection quantities may also occur.

SUMMARY OF THE INVENTION

In contrast, the method according to the present invention for determining the rail pressure of an injector including a voltage-controlled piezoelectrical actuator may provide the advantage that the pressure in the high-pressure channel of the injector is measured by measuring the induced piezovoltage. The result is a redundant pressure measurement, which makes it possible to monitor the measured value of the pressure sensor.

It may be advantageous that, using an algorithm, for example, in the form of a linear equation or a table, it is possible to reach conclusions regarding the prevailing rail pressure on the basis of the measured piezovoltage. In this manner, it is possible to obtain an electrical characteristic quantity that is assigned to the rail pressure and that may easily be further processed by the electronics.

By comparing the calculated rail pressure with the measured value of the pressure sensor, it is possible, in a manner, to monitor the normal functioning of the pressure sensor. If the pressure sensor fails, for example, as a result of a line break or a fault, then the redundant measured value may be retrieved for emergency operation in maintaining the functioning of the internal combustion engine.

In the case of a fault, it may be advantageous to store the measured voltage values or the pressure value, so that the event may be reconstructed at a later time point. This may be especially important for an internal combustion engine that includes a common rail injection system, to assure operating reliability.

An example embodiment of the present invention is illustrated in the drawings and is discussed in greater detail in the description below.

DETAILED DESCRIPTION

Figure 1:
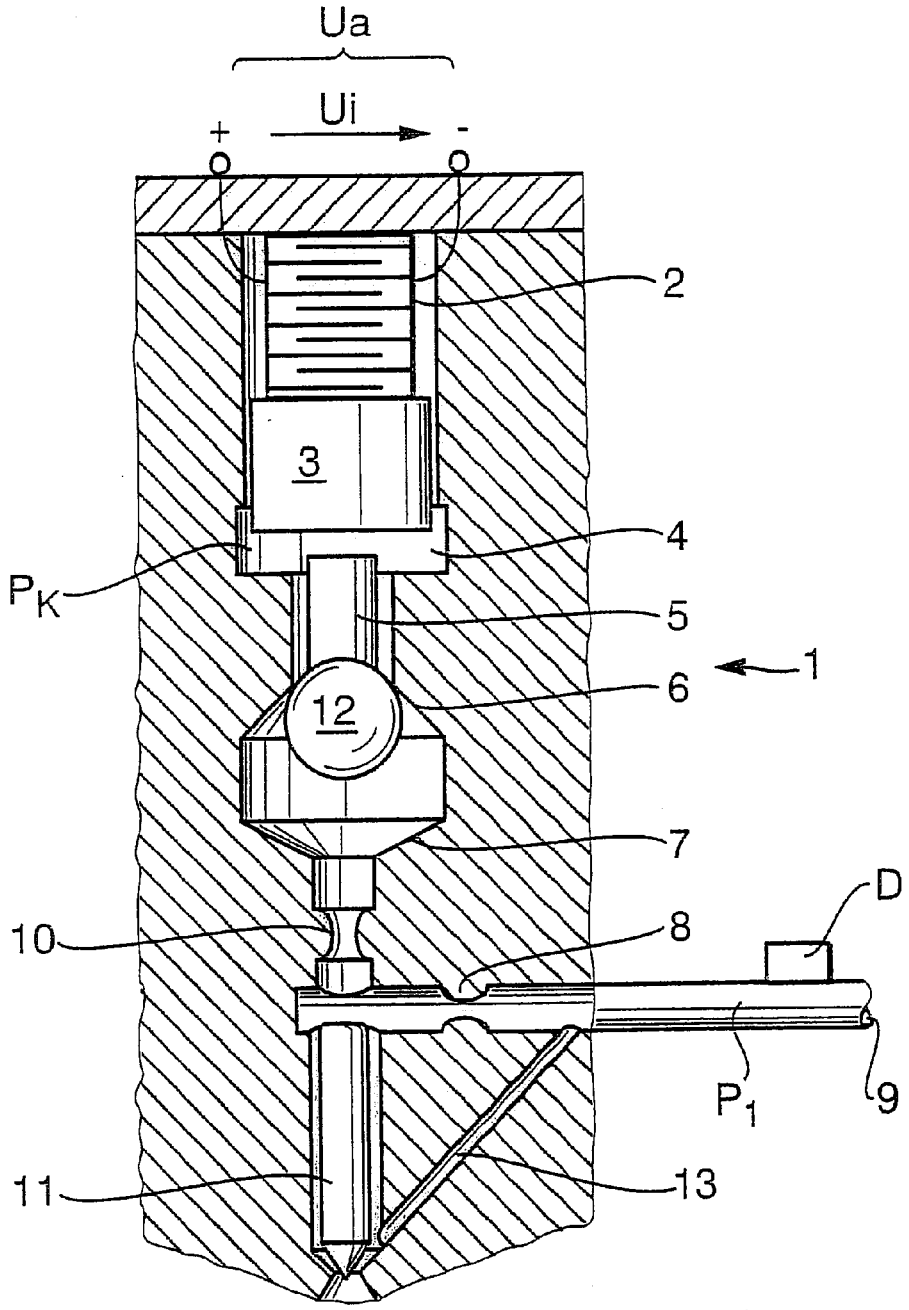
FIG. 1 illustrates a schematic representation of an injector including a piezoelectrical actuator.

FIG. 1, in a schematic representation, shows an injector 1 including a central bore. In the upper part of the bore, a piezoelectrical actuator 2 is introduced, at whose lower end an operating piston 3 is mounted. Operating piston 3 stops a hydraulic coupler 4 towards the top, the coupler including an opening towards the bottom including a connecting channel to a first seat and a control valve 5 including a sealing member 12 arranged in the coupler. In this context, sealing member 12 is configured so that it seals first seat 6, if actuator 2 is in the resting phase, i.e., if no drive voltage $U_a$ is applied to it. When actuator 2 is actuated by the application of drive voltage $U_a$ at clamps +, −, actuator 2 actuates operating piston 3 and, via hydraulic coupler 4, pushes control valve 5 including sealing member 12 in the direction of second seat 7. Arranged below second seat 7 in a corresponding channel is a nozzle needle 11, which closes or opens the outlet for high-pressure channel 13, for example, a common rail system, depending on the level of drive voltage $U_a$ and pressure $P_1$ that are applied in the high-pressure area. The high pressure is conveyed via a supply line 9 by the medium to be injected, for example, fuel for an internal combustion engine. Via a supply-line throttle 8 and an outlet throttle 10, the inflow quantity of the medium is controlled in the direction of nozzle needle 11 and hydraulic coupler 4. In this context, hydraulic coupler 4 is configured, on the one hand, to intensify the stroke of piston 5 and, on the other hand, to decouple control valve 5 from the static temperature expansion of actuator 2.

The dimensioning of hydraulic coupler 4 is such that the latter is refilled by a pressure derived from the rail pressure, specifically when sealing member 12 is positioned on first seat 6. This may be realized, for example, as a constant transmission ratio. If this transmission ratio is, for example, 1:10, then the pressure in hydraulic coupler 4 is only 1/10 of the rail pressure.

In what follows, the mode of functioning of injector 1 is discussed in greater detail. In response to each driving of actuator 2, operating piston 3 moves in the direction of hydraulic coupler 4. In this context, control valve 5 including sealing member 12 also moves in the direction of second seat 7. In this context, a portion of the medium in hydraulic coupler 4, for example, the fuel, is squeezed out through a leakage gap. Thus, between two injections, hydraulic coupler 4 must be refilled, to maintain its functional reliability. A coupler 4 that is empty or only partially filled has the effect that nozzle needle 11 may not release high-pressure channel 13 for the injection of the preestablished quantity of fluid, so that injection misfires may arise.

As described above, a high pressure predominates in supply line channel 9 amounting, in the common rail system, for example, to between 200 and 1600 bar. This pressure pushes against nozzle needle 11 and holds it closed against the pressure of an undepicted spring, so that no fuel may escape. If, as a consequence of drive voltage $U_a$, actuator 2 is actuated and therefore sealing member 12 moves in the direction of the second seat, then the pressure in the high-pressure area declines and nozzle needle 11 releases the injection channel. After drive voltage $U_a$ is withdrawn, hydraulic coupler 4 is once again refilled.

For the injection of fuel into an internal combustion engine, especially in direct injection, the fuel quantity to be injected should be determined as a function of the engine conditions and driving conditions of the vehicle. Determining the injection quantity should be accomplished as precisely as possible for each actuation of nozzle needle 11, in order to achieve an optimal combustion in the cylinder of the internal combustion engine with respect to exhaust gas emission requirements, fuel economy, and performance spectrum. Therefore, the instantaneous pressure may be measured using a pressure sensor that is arranged at an appropriate location in the high-pressure system of the common rail lines, and the instantaneous pressure is made available to an appropriate control unit as a measured value. Because this pressure sensor should operate very reliably, the present invention provides that a further pressure measurement be performed, which is redundant with respect to the measurement of the pressure sensor. This second pressure measurement is performed using the piezovoltage that is induced in piezoelectrical actuator 2, the piezovoltage arising as a result of the pressure in hydraulic coupler 4 and is measurable at actuator 2. On account of the fact that the coupler pressure, assuming complete charging, is a function of the rail pressure, the instantaneous rail pressure may be derived from the induced voltage. In this context, this induced voltage $U_i$ functions as a further (redundant) measuring signal for the pressure prevailing in high-pressure channel 13. For the pressure measurement, the control unit now receives two measured values, which make it possible, on the one hand, to monitor the measuring signal of the pressure sensor. On the other hand, in the event of the failure of the pressure sensor, induced voltage $U_i$ may be used to assure emergency operation of the internal combustion engine.

Figure 2:
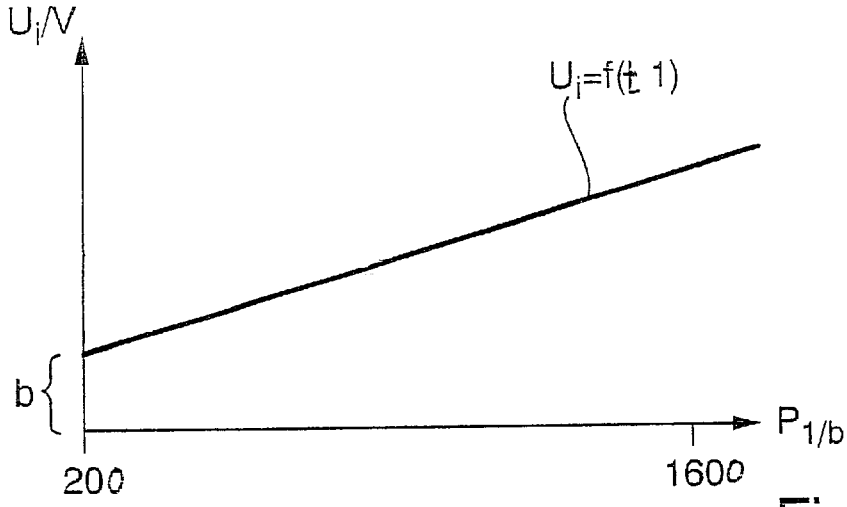
FIG. 2 illustrates an allocation diagram.

FIG. 2 illustrates an allocation diagram, in which voltage $U_i$, induced in actuator 2, is plotted on the y-axis and pressure $P_1$, measured by pressure sensor D for the high-pressure line system, is plotted on the x-axis. The curve $U_i=f(P_1)$ indicates the relationship between the two cited variables. Illustrated is a linear equation $$P_1=a*U_i+b,$$

a is the slope as a proportionality factor and b is an offset value. This curve may be used as an algorithm, alternatively to a table, which may be advantageously determined empirically.

Figure 3:
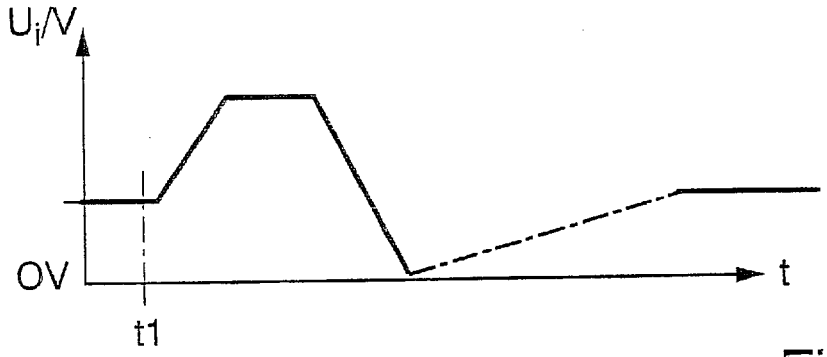
FIG. 3 illustrates a voltage diagram.

FIG. 3 illustrates a segment of a typical voltage diagram in which voltage $U_i$, applied at actuator clamps +, −, is plotted as a function of time. Initially, coupler 4 is filled by time point $t_1$, and the measured voltage corresponds to voltage $U_i$ that is induced by the coupler pressure.

After time point $t_1$, a driving occurs, in which the actuator is initially charged and, at a later time point, is once again completely discharged. In this context, coupler 4 is also emptied accordingly. However, due to the coupler pressure, a voltage $U_i$ is induced. The latter rises at a given gradient, because in this time period coupler 4 is once again filled, until it has reached its setpoint filling, i.e., until the static coupler pressure is built up.

To determine the high pressure, it may be advantageous to measure induced voltage $U_i$ at time point $t_1$. Derived from this measured value, in accordance with the aforementioned algorithm, is corresponding high-pressure $P_1$, which is compared to the measured value of pressure sensor D. In event of a deviation between measured high-pressure $P_1$ and comparison value $U_i$ beyond a preestablished threshold value, a check is performed as to whether a fault exists in the high-pressure system itself, or whether there is a fault in pressure sensor D. In the event of a fault in pressure sensor D, the pressure value from induced voltage $U_i$ is used for generating drive voltage $U_a$. Using this redundant measurement, it is therefore possible to maintain emergency operation for the fuel injection in an internal combustion engine.

Figure 4:
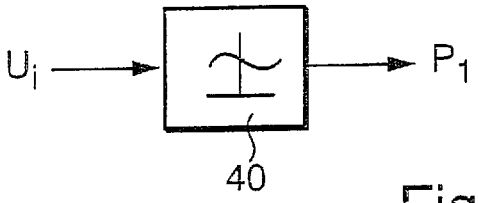
FIG. 4 illustrates a block diagram.

FIG. 4 illustrates a block diagram for generating the pressure value from piezovoltage $U_i$, measured at time point $t_1$. The algorithm for the conversion is stored in a transformation unit 40. This algorithm may contain the function $P_1=f(U_i(t_1))$ according to FIG. 2 or an appropriate table. The output signal for pressure $P_1$ then functions as a plausibility check for the measured rail pressure, or as a replacement value for the rail pressure in the event of a fault.

What is claimed is:

1. A method for determining a rail pressure of an injector including a voltage-controlled piezoelectrical actuator, the method comprising the steps of:

actuating a nozzle needle by using a hydraulic coupler of the voltage-controlled piezoelectrical actuator to release a quantity of a fluid that is acted upon by a rail pressure in a high-pressure channel;

acting upon the voltage-controlled piezoelectrical actuator by the rail pressure via the hydraulic coupler;

generating a piezovoltage in the voltage-controlled piezoelectrical actuator; and determining the rail pressure from the piezovoltage using a preestablished algorithm.

2. The method of claim 1, wherein the rail pressure is determined in accordance with a linear equation:

$$P_1=a*U_i+b,$$

a being a proportionality factor and b being an offset value.

3. The method of claim 1, wherein a plurality of comparison values are stored in a table.

4. The method of claim 1, wherein the piezovoltage is measured, in temporal terms, immediately before a subsequent charging operation of the hydraulic coupler.

5. The method of claim 1, further comprising:

measuring the rail pressure by a pressure sensor arranged in a location in a high-pressure system; and comparing the measured rail pressure to the calculated rail pressure.

6. The method of claim 5, further comprising:

generating a fault message in an event that a difference between the measured rail pressure and the calculated rail pressure one of exceeds and falls below a preestablished threshold value.

7. The method of claim 6, further comprising:

storing the fault message.

8. The method of claim 1, further comprising:

using the injector for injecting a fuel into a common rail system of an internal combustion engine.

9. The method of claim 5, further comprising:

recognizing an emergency-operating function is recognized when a preestablished threshold value is exceeded.

* * * * *